US009193943B1

(12) United States Patent
Hatle et al.

(10) Patent No.: US 9,193,943 B1
(45) Date of Patent: Nov. 24, 2015

(54) TREATMENT KIT FOR CLEANING SUBSTRATE SURFACES FOR REMOVAL OF WATER AND NON-WATER SOLUBLE OXIDES AND IONIC COMPOUNDS

(71) Applicant: CORRLINE INTERNATIONAL, LLC, Houston, TX (US)

(72) Inventors: Loren L. Hatle, Humble, TX (US); James J. Knocke, Cleveland, TN (US)

(73) Assignee: TGS SOLUTIONS, LLC, Houston, TX (US)

( * ) Notice: Subject to any disclaimer, the term of this patent is extended or adjusted under 35 U.S.C. 154(b) by 0 days.

(21) Appl. No.: 13/750,445

(22) Filed: Jan. 25, 2013

Related U.S. Application Data

(60) Provisional application No. 61/591,028, filed on Jan. 26, 2012.

(51) Int. Cl.

| | |
|---|---|
| ***C11D 17/04*** | (2006.01) |
| ***C11D 7/26*** | (2006.01) |
| ***C11D 7/28*** | (2006.01) |
| ***C11D 7/54*** | (2006.01) |
| ***C11D 17/00*** | (2006.01) |
| ***C11D 17/06*** | (2006.01) |

(52) U.S. Cl.
CPC ..... *C11D 17/0008* (2013.01); *C11D 17/06* (2013.01)

(58) Field of Classification Search
CPC .... C11D 17/04; C11D 11/0029; C11D 3/162; C11D 3/0047; C11D 3/124; C11D 3/2082; C11D 3/2086; C11D 3/222; C11D 3/245; C11D 3/3942
USPC ..... 510/439, 438, 245
See application file for complete search history.

(56) References Cited

U.S. PATENT DOCUMENTS

| | | | | |
|---|---|---|---|---|
| 4,234,442 | A * | 11/1980 | Cornelissens | 510/277 |
| 4,622,161 | A * | 11/1986 | Cornelissens et al. | 510/439 |
| 5,160,654 | A * | 11/1992 | Falou et al. | 510/277 |
| 6,620,457 | B2 | 9/2003 | Farmer et al. | |
| 2003/0162685 | A1 * | 8/2003 | Man et al. | 510/445 |
| 2004/0002433 | A1 * | 1/2004 | Buckland et al. | 510/302 |
| 2009/0048141 | A1 * | 2/2009 | Spadoni et al. | 510/475 |
| 2012/0291815 | A1 * | 11/2012 | Monsrud et al. | 134/25.2 |

* cited by examiner

*Primary Examiner* — Lorna M Douyon
(74) *Attorney, Agent, or Firm* — Buskop Law Group, PC; Wendy Buskop

(57) ABSTRACT

A powder treatment kit for decontaminating metal and metal containing surfaces, removing mill scale, improving the integrity of weldments, removing sulfides, greatly reducing surface oxidation, and mitigating the failure of protective coatings. The powder treatment kit for cleaning substrate surfaces for removal of water and non-water soluble oxides, ionic compounds, oxidized metal species, or other contaminants, comprising a surface pH modifier with a weight percent from 30 percent to 90 percent; a water-soluble oxidizer to react with non-water-soluble sulfides attached to the metal surface, to be dispersed, in an amount from 0.1 wt % to 50 wt %; a pH buffer to maintain a resulting solution pH from 1.5 weight percent to 69.8 weight percent; and a surface tension reducing component.

6 Claims, No Drawings

TREATMENT KIT FOR CLEANING SUBSTRATE SURFACES FOR REMOVAL OF WATER AND NON-WATER SOLUBLE OXIDES AND IONIC COMPOUNDS

CROSS REFERENCE TO RELATED APPLICATIONS

The current application claims priority to and the benefit of U.S. Provisional Patent Application Ser. No. 61/591,028 filed on Jan. 26, 2012, entitled "TREATMENT FOR PROVIDING IMPROVED ADHESION OF BARRIER COATINGS TO METALS." This reference is hereby incorporated in its entirety.

FIELD

The present embodiments generally relate to a surface preparation composition designed to remove water-soluble and non-water soluble contaminants on metal and metal containing substrates resulting in greatly reduced potential for corrosion, improved adhesion of barrier coatings and increased asset life.

BACKGROUND

A need exists for a powder concentrate that can be easily transported and then liquefied for treating a surface such as a ship hull to remove the corrosion mechanism, enable improved bonding resulting in a watertight connection for bottom paints; wherein the metals of the hulls are exposed to water.

A further need exists for a liquid material that can be thinly applied to metals, such as offshore oil rig metals, enabling barrier coatings to bond better to the surfaces reducing oxidation of the metals and improving reliability of the metal and reduced metal degradation.

A need exists for a composition to decontaminate and remove microscopic water-soluble and non-water-soluble contaminants from metal; remove mill scale; and improve the integrity of weldments; forestall contaminant related flash rust; forestall contaminant related rust back; to prevent corrosion and to significantly mitigate the failure of protective coatings; and make paint and marine coatings adhere to ship hulls more tenaciously resulting in longer coating life and decreased maintenance costs.

For example, a need exists for a composition that can eliminate contaminants; thereby greatly reducing flash rust induced by contaminants and rust back induced by contaminants, while allowing non-contaminant related oxidation to occur. For example, non-contaminant related oxidation can be oxidation caused by iron and exposed to oxygen.

The present embodiments meet these needs.

DETAILED DESCRIPTION OF THE EMBODIMENTS

Before explaining the present compositions in detail, it is to be understood that the compositions are not limited to the particular embodiments and that they can be practiced or carried out in various ways.

The present embodiments generally relate to a composition which can be in powder form or liquid form.

The compositions are used to treat metals that may then be coated with moisture barriers, allowing the molecules of the moisture barriers, which can be paints, to adhere more tightly to the metal preventing corrosion and oxidation due to the removal of the corrosion mechanism, i.e. water soluble and insoluble ionic materials that participate in the cathodic corrosion mechanism.

The composition can allow fleets to last longer with less maintenance; therefore, at lower cost.

The composition can be used to maintain the integrity of pipelines, preventing them from failing prematurely, thereby keeping oil coming from Alaska to the lower 48 more consistently at lower cost due to reduced maintenance requirements.

The composition can be used on bridges to prevent occurrences, such as the bridge that fell in Minnesota in 2009, to ensure a longer life to the metal components of the bridge; allowing maintenance money to be spent on additional job creation in another sector.

Another benefit of the invention is that the composition will protect the environment by preventing environmental disasters, such as sinking offshore oil rigs, by preventing small holes developing in the metal, such as from unprotected metal cathodic degradation.

One or more embodiments relates to a powder concentrate for providing improved adhesion of barrier coatings due to reduction of contaminants and removal of the key corrosion mechanism.

Moisture can eventually reach the substrate, sub-coating, via coating penetration from fresh water, such as rain, or sea water. The moisture can be a moisture laden gas contact or a fluid contact.

The powder concentrate can have a surface pH modifier to create an acidic environment on the substrate surface.

In an embodiment, the surface pH modifier can have a mild surface etching effect that can cause microscopic etching on the surface of the metal; however, the intended mechanism is to address only surface contaminants In one or more embodiments, the surface pH modifier can be a partial salt of a strong acid.

The reduced pH will solubilize or disperse most of the oxidized metal species. The surface pH modifier has a weight percent from 30 percent to 90 percent of the total composition. Citric acid can work well as a surface pH modifier and/or buffering agent In an embodiment of the formulation, the surface pH modifier can be 82.2 weight percent of the total composition.

A use of a combination can be a ratio of 50:50 of citric acid to lactic acid. As another example, the ratios can be between 80:20 and 20:80.

A simple technique to achieve an oxygen barrier is to use a rheology modifier to aid in creating improved adhesion of the composition to vertical metal surfaces—this vertical adhesion is known in the coating industry as "vertical cling". The composition provides improved "vertical cling" or enhanced surface contact.

The rheology modifier to create the pH modified surface can be in an amount from 3 weight percent to 68.3 weight percent based on the total weight of the composition.

In an example, 11.8 weight percent of the rheology modifier can be used when the composition uses 82.2 weight percent of the surface pH modifier and the balance of the weight percent includes the additional ingredients named below.

The oxygen barrier can be a gum such as xanthan gum, guar gum, smectite clay, carbohydrate polymer thickener, silica based synthetic thickeners and combinations thereof, or any material that thickens or adds body to the solution.

In an example, xanthan gum, a carbohydrate polymer thickener, can be used from 25:75.

A water-soluble oxidizer is part of the formulation and is used in an amount from 0.1 weight percent to 15 weight percent based on the total formulation.

In an embodiment, the water-soluble oxidizer can be used in an amount of 3.6 weight percent of the total formulation when 11.8 weight percent of gum (rheology modifier) is used and 82.2 weight percent of the surface pH modifier is used.

A pH buffer is part of the formulation to maintain the pH of the resulting solution or the liquid embodiment of the composition.

The pH buffer is used in amounts from 1.5 weight percent to 69.8 weight percent of the total formulation.

An embodiment that uses 2.3 weight percent of the pH adjuster can further include the water-soluble oxidizer in an amount of 3.6 weight percent, 11.8 weight percent of gum, and 82.2 weight percent of the surface pH buffer.

The composition can use a surface tension reducing component.

The surface tension reducing component can be a non-ionic silicone polyether, a flouroalkyl wetter, a super wetter, a surfactant or combination thereof.

The surface tension reducing component can be used in amounts from 0.1 weight percent to 5 weight percent of the total formulation.

In an embodiment of the composition that is liquid, the surface tension reducing component can be Q2-5211 made by Dow Corning of Michigan.

In one or more embodiments, the surface tension reducing component can be a non-ionic silicone polyether.

In one or more embodiments, the powder concentrate can be mixed in purified water for a liquid application of the composition.

In an embodiment, the water can be low conductivity water. In another embodiment, the water can be deionized water with a conductivity of less than 18 micro-mhos.

If a liquid embodiment is used, one of the surface pH modifiers can be acetic acid; which is a liquid.

One or more embodiments can include an additional treatment component selected from the group comprising: a second formulation comprising an alkaline material, such as, sodium carbonate, sodium bicarbonate, (other) and rheology modifier; a third formulation of dimethylethanolamine (DMEA); or the second formulation and the third formulation. The DMEA can be supplied as a concentrate to be reduced with purified water or as a ready-to-use solution.

In one or more embodiments, the second formulation can be a neutralizing formulation.

In one or more embodiments, the third formulation can contain a fugitive alkaline pH adjuster. In one or more embodiments, the fugitive alkaline pH adjuster can be a volatile amine, such as dimethylethanolamine.

In one or more embodiments, the third formulation may or may not contain water, such as purified water.

The surface pH modifier can be selected from the group of components comprising: citric acid, lactic acid, other low molecular weight organic acids, monosodium phosphate, partial salts of sulfuric acid, and combinations thereof. Other surface pH modifiers and can be used, such as other mild acids and surface etching agents in other embodiments.

The low molecular weight organic acids can be conjugate bases of organic acids.

The partial salts of sulfuric acid can be a member of the group: potassium bisulfate, magnesium bisulfate, ammonium bisulfate, and combinations thereof.

The oxygen barrier can be a gum selected from the group: xanthan gum, guar gum, smectite clay, carbohydrate polymer thickeners, silica based synthetic thickeners, and combinations thereof. The silica based synthetic thickener can be amorphous fumed silica, such as AEROSIL™ 200 available from Evonik Industries of Germany.

The water-soluble oxidizer reacts with sulfides, wherein the reaction products are released from the surface and dispersed in the rinseate. The water soluble oxidizer component may be a member of the group comprising: a sodium persulfate, a perborate, a percarbonate, the like, and combinations thereof.

The pH adjuster can be a member of the group comprising: sodium bisulfate, potassium bisulfate, magnesium bisulfate, ammonium bisulfate, and combinations thereof.

In one or more embodiments, the surface tension reducing component can be a non-ionic silicone polyether, such as BETTER WETTER™ manufactured by Reynolds Soil Technologies of Australia.

One or more embodiments relate to a treatment kit for providing improved adhesion of barrier coatings to metals exposed to moisture.

A first liquid surface treatment composition can include a pH buffer, wherein the composition maintains an acidic surface on a substrate. The reduced pH of the first liquid surface treatment composition will solubilize or disperse most of the oxidized metal species and contaminants. The surface pH modifier has a weight percent from 3 percent to percent, such as Citric acid. The oxidized metal species can be ferrous materials and ferric compounds.

The liquid surface treatment composition uses purified water that can be deionized water, reverse osmosis produced water, distilled water, and combinations thereof.

In another embodiment, the liquid surface treatment composition can use purified water that has a pH between 5 and 8.

The first liquid surface treatment composition can include an oxygen-barrier to achieve the pH modified surface in an amount from 0.3 weight percent to 2.5 weight percent.

The first liquid surface treatment composition can include an oxidizer to react with sulfides attached to, or associated with, the metal surface in an amount from 0.1 weight percent to 7 weight percent. In one or more embodiments the oxidizer can be water-soluble and perform the dispersing. In another embodiment, the oxidizer can be used to react with the sulfides, such as iron sulfide, providing reaction byproducts, after oxidation, such as iron (zero valance) and sulfur (zero valance); and the reaction byproducts can be dispersed in the rinseate. Various metal sulfides, including various iron sulfides, have been associated with subsequent corrosion issues on metal surfaces after surface preparation. This kit teaches removal of the corrosion mechanism.

A chelating agent can be used to stabilize the water-soluble oxidizer. The chelating agent can be a phosphonate, phosphate, polycarboxylic acid or combination thereof.

The first liquid surface treatment composition can include a pH adjuster to maintain the pH of the concentrate in an amount from 0.05 weight percent to 6.5 weight percent, such as potassium or sodium bisulfate.

The first liquid surface treatment composition can include a surface tension reducing component consisting of the group: a super wetter, a surfactant, or combinations thereof; which can constitute from 0.001 weight percent to 5 weight percent of the total formulation.

The first liquid surface treatment composition can include Q.S. with purified water, wherein Q.S. stands for the conventional chemical term "quantity sufficient" to create a liquid solution of the powder components in the liquid.

In an embodiment, specific stoichiometric ratios of powder to purified water can be used achieve making 5 gallons of solution, 1 gallon of solution, or another defined quantity.

The treatment kit for providing improved adhesion of barrier coatings to metals, subsequentially exposed to moisture, can include one or more additional treatment components selected from the group comprising: a second formulation comprising an alkaline material, such as, sodium carbonate, sodium bicarbonate, and rheology modifier; a third formulation of dimethylethanolamine; one or more additional first formulations, a fast dry apparatus, combinations thereof; or a d.i. water rinse.

In an embodiment, the third formulation has a pH above 7. By using a third formulation with an alkaline pH the surface molecules will not form the oxides observed during acid evaporation.

An advantage of the present invention is that the treatment kit not only decontaminates and removes microscopic contaminates from metal, mill scale, and improves the integrity of weldments; but it also forestalls contaminant related flash rust, forestalls contaminant related rust back, and can prevent corrosion to significantly mitigate the failure of protective coatings and make paint and marine coatings stick to ship hulls better and longer.

Another advantage of the invention is that the compositions of the first formulation with combinations of the second and third formulation, used in series, can eliminate contaminants; thereby eliminating flash rust induced by contaminants and rust back induced by contaminants, while allowing non-contaminant related oxidation to occur.

The water can be low conductivity water. The water can be deionized water with a conductivity of less than 18 micromhos.

The purified water in an embodiment is water with the greatly reduced levels of electrolytes.

The kit can be used in many ways.

By way of a first example, the first formulation can be combined with the third formulation. By way of a second example, the first formulation can be combined with an additional first formulation and then with the third formulation. By way of a third example, first formulation can be agitated, such as by using a vibration generator, a roller, or the like, and then the third formulation can be combined with the first formulation. By way of a fourth example, the first formulation can be combined with the d.i. water rinse, and then a fast dry operation can be performed. Then a fast dry operation can be performed to prevent pooling of the d.i. water rinse. The fast dry operation can be performed using a towel, an air knife, heat, or the like.

While these embodiments have been described with emphasis on the embodiments, it should be understood that within the scope of the appended claims, the embodiments might be practiced other than as specifically described herein.

What is claimed is:

1. A treatment kit for cleaning substrate surfaces for removal of water and non-water soluble oxides and ionic compounds comprising:

a. a first powder concentrate formulation for reacting with surface contaminates on a hard surface and dispersing the surface contaminates using a first powder concentrate followed by an additional liquid component for sequentially adjusting the pH of the substrate surface consisting of, based on the weight of the first powder concentrate formulation:

(i) from 40 weight percent to 90 weight percent of an organic acid surface pH modifier for creating an acidic surface on a substrate to disperse oxidized metal species and contaminants, wherein the organic acid surface pH modifier is selected from the group consisting of: citric acid, lactic acid, monosodium phosphate, partial salts of sulfuric acid, and combinations thereof;

(ii) from 0.1 weight percent to 50 weight percent of a water-soluble oxidizer to react with and disperse non-water-soluble sulfides, wherein the water-soluble oxidizer is selected from the group: a sodium persulfate, a perborate, a percarbonate, and combinations thereof;

(iii) from 1.5 weight percent to 69.8 weight percent of a pH buffer to maintain a resulting solution pH, wherein the pH buffer is selected from the group consisting of: a sodium bisulfate, potassium bisulfate, magnesium bisulfate, ammonium bisulfate, and combinations thereof;

(iv) from 0.1 weight percent to 5 weight percent of a surface tension reducing component selected from the group consisting of: a flouroalkyl wetter, a non-ionic silicone polyether and combinations thereof; and (v) optionally, from 3 weight percent to 68.3 weight percent of a rheology modifier to enhance vertical cling;

b. an additional liquid treatment component comprising: a fugitive alkaline pH adjuster; and optionally, a deionized water rinse.

2. The treatment kit of claim 1, wherein the rheology modifier is present in the first powder concentrate formulation.

3. The treatment kit of claim 2, wherein the rheology modifier allows the resulting solution to form an oxygen barrier on the substrate.

4. The treatment kit of claim 3, wherein the oxygen barrier is a gum selected from the group consisting of: xanthan gum, guar gum, smectite clay, carbohydrate polymer thickeners, silica based synthetic thickeners, and combinations thereof.

5. The treatment kit of claim 4, wherein the silica based synthetic thickener is an amorphous fumed silica.

6. The treatment kit of claim 1, wherein the fugitive alkaline pH adjuster is a volatile amine, such as dimethylethanolamine.

* * * * *